US007775366B2

(12) United States Patent
Goto et al.

(10) Patent No.: US 7,775,366 B2
(45) Date of Patent: Aug. 17, 2010

(54) REFILL CONTAINER

(75) Inventors: Kazuhiro Goto, Kakegawa (JP); Sachiko Toyoda, Kakegawa (JP)

(73) Assignee: Shiseido Company, Ltd., Tokyo (JP)

( * ) Notice: Subject to any disclaimer, the term of this patent is extended or adjusted under 35 U.S.C. 154(b) by 103 days.

(21) Appl. No.: 11/737,239

(22) Filed: Apr. 19, 2007

(65) Prior Publication Data

US 2007/0187284 A1 Aug. 16, 2007

Related U.S. Application Data

(63) Continuation of application No. 10/311,163, filed as application No. PCT/JP01/05301 on Jun. 21, 2001, now Pat. No. 7,322,478.

(30) Foreign Application Priority Data

Jun. 23, 2000 (JP) ..... 2000-190164
Aug. 11, 2000 (JP) ..... 2000-245262
Nov. 30, 2000 (JP) ..... 2000-366022

(51) Int. Cl.
*B65D 25/00* (2006.01)
*A45D 40/22* (2006.01)
*A45D 33/26* (2006.01)

(52) U.S. Cl. ..... 206/581; 206/501; 206/823

(58) Field of Classification Search ..... 206/581, 206/823, 501, 235, 499, 514; 132/293, 294, 132/300, 314; 220/740, 737, 23.2, 23.6
See application file for complete search history.

(56) References Cited

U.S. PATENT DOCUMENTS 1,535,522 A * 4/1925 Dolan ..... 229/5.6
1,775,516 A 9/1930 Farrington
3,311,248 A * 3/1967 Marchant ..... 215/13.1
4,446,879 A * 5/1984 Gueret ..... 132/293
4,807,773 A 2/1989 Tsai
5,148,941 A 9/1992 Chezek (Continued)

FOREIGN PATENT DOCUMENTS

JP 60-94105 6/1985

(Continued)

*Primary Examiner*—Mickey Yu
*Assistant Examiner*—Steven A. Reynolds
(74) *Attorney, Agent, or Firm*—Ladas & Parry LLP

(57) ABSTRACT

The present invention relates to a refill container that holds and protects an internal tray filled with a cosmetic material. The refill container that holds the internal tray filled with the cosmetic material is made up of a mounting portion and an engaging portion. The mounting portion has a structure to be mounted over the internal tray in such a manner as to cover an exposed surface of the cosmetic material. The mounting portion has a lid portion that faces the exposed surface and protects the exposed surface in a mounted state and a holding portion that holds the internal tray in such a manner that the internal-tray bottom surface of the internal tray is exposed in the mounted state. Further, in the mounted state of the internal tray being mounted in the mounting portion, the engaging portion catches the internal tray in such a manner as to prevent the internal tray from being disengaged from the mounting portion. Thus, it is possible to reduce the size of the refill container and improve the mounting operation of the internal tray.

1 Claim, 16 Drawing Sheets

U.S. PATENT DOCUMENTS

| | | | | |
|---|---|---|---|---|
| 5,377,860 | A | 1/1995 | Littlejohn et al. | |
| 5,598,929 | A | 2/1997 | Jensen et al. | |
| 5,931,169 | A | 8/1999 | Kervoalen | |
| 5,938,016 | A * | 8/1999 | Erdtmann | 206/221 |
| 6,047,710 | A * | 4/2000 | Irving et al. | 132/293 |
| 6,129,089 | A | 10/2000 | Yuhara | |
| 6,293,286 | B1 | 9/2001 | Gueret | |

FOREIGN PATENT DOCUMENTS

| | | |
|---|---|---|
| JP | 60-158510 | 10/1985 |
| JP | 2-12309 | 1/1990 |
| JP | 6-3208 | 1/1994 |
| JP | 10075817 | 3/1998 |
| JP | 11276240 | 3/1998 |

* cited by examiner (A)

(B)

REFILL CONTAINER

TECHNICAL FIELD

The present invention relates to a refill container and specifically relates to a refill container that is used for holding and protecting an internal tray filled with a cosmetic material.

In general, compacts for solid cosmetic materials or powdery cosmetic materials (hereinafter simply referred to as "cosmetic materials") are configured so that trays filled with cosmetic materials can be mounted in its inside. When the cosmetic materials in the trays are used up, new trays filled with cosmetic materials are purchased to replace the used trays. The purpose of these configurations is to bring about convenience and economical efficiency.

Therefore, the trays are sold filled with cosmetic materials. If the trays filled with the cosmetic materials were shipped and sold merely as they are, the cosmetic materials might be scattered out of the trays in the shipping and selling processes. Therefore, the trays filled with the cosmetic materials are further held in refill containers and thereafter they are shipped and sold.

BACKGROUND ART

FIG. 1 and FIG. 2 show a refill container 1 of a conventional example. The refill container 1 is a plastic molding, which generally consists of a refill main body 2 and a lid portion 3. The refill main body 2 and the lid portion 3 are linked by means of a hinge portion 4. In this configuration, the lid portion 3 can be rotated about the hinge portion 4 so as to be opened or closed relative to the refill main body 2.

The refill main body 2 defines a housing space 5, in which an internal tray 6 (made of plastic) filled with a cosmetic material 7 is housed. In this conventional configuration, the bottom portion of the internal tray 6 is first introduced and thus the internal tray 6 is housed in the refill main body 2. Therefore, when the internal tray 6 is housed in the housing space 5, the cosmetic material 7 is still in an exposed state. Then, the lid portion 3 is closed in order to protect the surface of the cosmetic material 7 as shown in FIG. 2, in which state the shipping and selling is carried out.

There is, however, a problem with the refill container 1 of the above-mentioned conventional configuration. The problem is that the refill container 1 consisting of the refill main body 2 and the lid portion 3 is large in size and therefore high in cost. When the internal tray 6 is taken out of the refill container and thereafter is put into a compact, then the refill container 1 is discarded as waste. Therefore, where there are requirements of reducing waste volume and reducing cost, the refill container 1 needs to be designed as small as possible and to use less material to form the container itself.

Further, with the conventional refill container 1, in order to mount the internal tray 6 in the refill container 1, first it is necessary to place the internal tray 6 into the housing space 5 of the refill main body 2 and thereafter it is necessary to close the lid portion 3. Thus, there are two steps required. As a result, the operation of mounting the internal tray 6 in the refill container 1 is complicated and is of low efficiency. This is considered to be a problem.

DISCLOSURE OF THE INVENTION

It is a general object of the present invention to provide a refill container that solves the above mentioned problems of the conventional art.

It is a more specific object of the present invention to provide a refill container that enables reduction in size as well as improvement in mounting operation.

In order to attain these objects, according to the present invention, there is provided a refill container that holds an internal tray filled with a cosmetic material, comprising:

a mounting portion having a structure to be mounted over said internal tray in such a manner as to cover an exposed surface of said cosmetic material, said mounting portion comprising a lid portion that faces said exposed surface and protects said exposed surface in a mounted state and a holding portion that holds said internal tray in such a manner that the bottom surface of said internal tray is exposed in said mounted state; and an engaging portion that engages with said internal tray in said mounted state of said internal tray being mounted in said mounting portion in such a manner as to prevent said internal tray from being disengaged from said mounting portion.

According to the present invention, the refill container is of a configuration having the mounting portion and the engaging portion. The mounting portion has the lid portion and the holding portion. The holding portion holds the internal tray with the bottom surface of the internal tray exposed in the mounted state. The lid portion faces the exposed surface and protects the exposed surface.

In the mounted state, the bottom surface of the internal tray is thus exposed from the mounting portion. On the other hand, the exposed surface of the cosmetic material as stated above is protected with the lid portion. Therefore, the cosmetic material does not deteriorate, despite the bottom surface of the internal tray being exposed to the outside.

Further, in order to mount the internal tray in the refill container, it is sufficient to merely insert the internal tray into the mounting portion, which achieves the engagement between the internal tray and the engaging portion. Therefore, the internal tray can be mounted in the refill container by a single motion of inserting the internal tray into the mounting portion, which means that the operation to mount internal trays in refill containers is simplified and the efficiency of the operation can be improved.

Further, as compared with a prior art configuration of completely housing an internal tray within a refill container that consists of a refill main body and a lid portion, the refill container of this claim has the structure that holds the internal tray in such a manner as to cover the exposed surface of the cosmetic material which needs to be protected with the highest priority, while the bottom surface of the internal tray is in the exposed state. Therefore, the refill container can be designed to have a reduced size and its cost of materials can be reduced.

Further, the present invention may be characterized in that said refill container comprises a turn-back portion formed at the periphery of said mounting portion, wherein said turn-back portion comprises a turn-back end portion that protrudes from the bottom surface of said internal tray when said internal tray is mounted in said mounting portion.

According to the present invention, the mounting portion can be reinforced by forming the turn-back portion at the periphery of the mounting portion. Thus, the internal tray can be protected with increased reliability.

Further, the turn-back end portion of the turn-back portion protrudes from the bottom surface of the internal tray when the internal tray is in the mounted state in the mounting portion. Because of this configuration, the protruding portion serves as a buffer when an external shock is applied. Thus, the internal tray can be protected further reliably.

Further, the present invention may be characterized in that said refill container comprises a structure wherein said engaging portion engages with the bottom surface of said internal tray.

According to the present invention, since there is the structure wherein the engaging portion catches the bottom surface of the internal tray, it is not necessary to form a structure (for example, a groove portion) in the internal tray that engages with the engaging portion. The internal tray can be held in the refill container reliably.

Further, the present invention may be characterized in that said mounting portion is provided with a finger hold portion for taking out said internal tray when said internal tray is being detached from said mounting portion.

According to the present invention, since the mounting portion is provided with the finger hold portion for taking out the internal tray when the internal tray is being detached from the mounting portion, the user can take out the internal tray from the mounting portion, by gripping the internal tray by way of the finger hold portion. Thus, the detaching motion can be easily performed.

Further, the present invention may be characterized in that said refill container comprises an inclined surface formed at a position of a sidewall of said lid portion that at least faces said finger hold portion.

According to the present invention, since there is the inclined surface formed at the position of the sidewall of the lid portion that at least faces the finger hold portion, the inclined surface can provide a clearance for a cutter to form the finger hold portion and makes it possible to use the cutter, which is made of steel and relatively thick. Therefore, the finger hold portion can be formed efficiently and, in addition, the finger hold portion can be formed deeply, which enhances the user-friendliness when the user detaches the internal tray from the mounting portion.

Further, the present invention may be characterized in that said refill container comprises a finger grip portion formed at a surface other than a surface at which said finger hold portion is disposed, wherein said finger grip portion extends outward and is capable of being gripped when said internal tray is detached from said mounting portion.

According to the present invention, there is the finger grip portion formed at the surface other than the surface at which the finger hold portion is disposed, and the finger grip portion extends outward and is capable of being gripped when the internal tray is detached from the mounting portion. Therefore, when the internal tray is detached from the mounting portion, it is possible to detach the internal tray from the mounting portion by gripping the finger grip portion and pulling it away from the internal tray. Thus, the motion to detach the internal tray from the mounting portion can be carried out more easily than conventionally.

BRIEF DESCRIPTION OF THE DRAWINGS

Other objects, features and advantages of the present invention will become clearer by reference to the attached drawings and by reading the following detailed description.

BEST MODE FOR CARRYING OUT THE INVENTION

Figure 1:
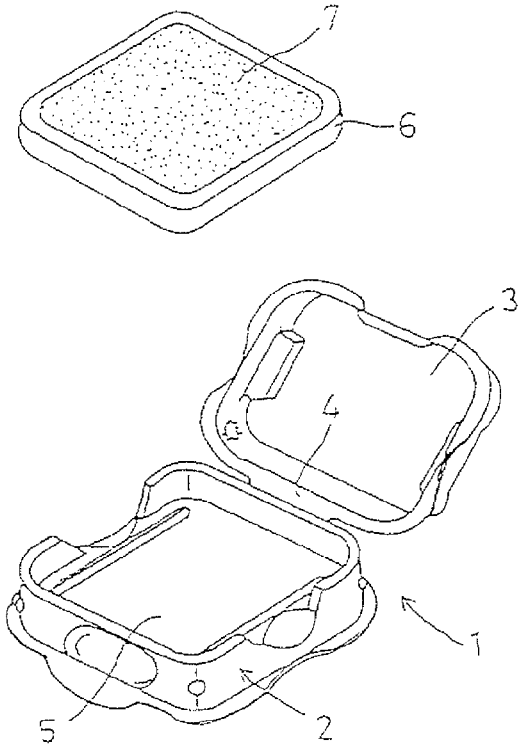
FIG. 1 PRIOR ART
FIG. 1 is a perspective view showing a conventional refill container with its lid opened.

The embodiments of the present invention are described below, with reference to the drawings.

FIGS. 3 through 7 show a refill container 10A according to a first embodiment of the present invention. The refill container 10A holds and protects an internal tray 11A whose inside is filled with a cosmetic material 12. In this embodiment, the cosmetic material 12 is illustrated as one using a powdery cosmetic material, for example, a foundation, etc.

The refill container 10A is made of plastic material by integral molding, using, for example, a vacuum forming technique or an injection molding technique, etc. As for a material, recycled amorphous polyethylene terephthalate (APET) is employed in this embodiment. The recycled amorphous polyethylene terephthalate (APET) is less costly than brand new plastics (i.e., plastics other than recycled materials). Therefore, the cost of the refill container 10A can be reduced by employing the recycled APET. It also provides the capability to address environmental issues, more specifically, recycling promotion and waste reduction, etc.

This embodiment employs the recycled APET, however, it should be noted that it is also possible to employ other materials: PS (polystyrene), PP (polypropylene) PVC (Polyvinyl Chloride), etc., in place of the recycled APET. The refill container 10A may be translucent or opaque. It does not have to be transparent, although APET is transparent.

Now, the specific structure of the refill container 10A is described in detail.

The refill container 10A is generally made up of a mounting portion 20A, an engaging portion 21A, a turn-back portion 22, etc. As mentioned above, the mounting portion 20A, the engaging portion 21A and the turn-back portion 22 are integrally formed by vacuum-forming, etc.

The mounting portion 20A is the part to which the internal tray 11A filled with the cosmetic material 12 is mounted. The mounting portion 20A has a shape generally defining a bottom. This mounting portion 20A has a structure having a holding portion 23A, a lid portion 24, a step portion 25, etc.

Figure 5:
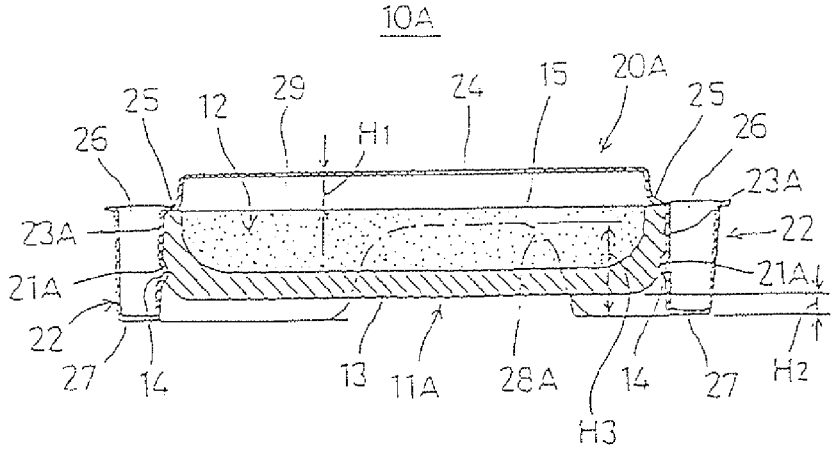
FIG. 5 is a sectional view taken along the line B1-B1 of FIG. 4.
Figure 6:
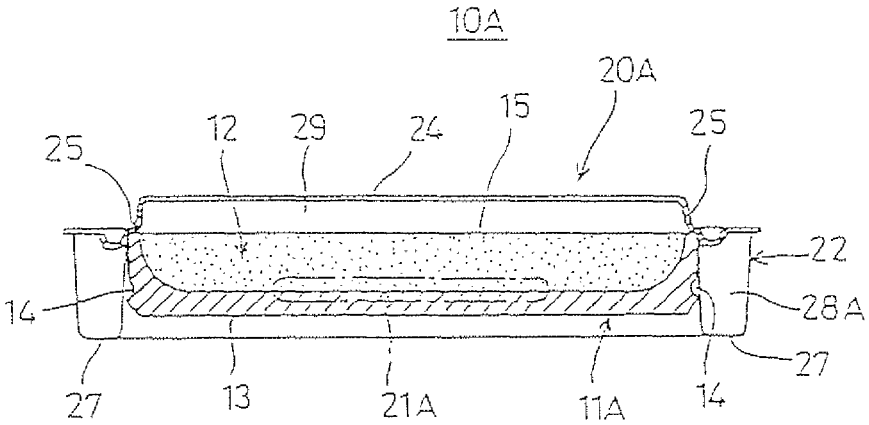
FIG. 6 is a sectional view taken along the line A1-A1 of FIG. 4.
Figure 7:
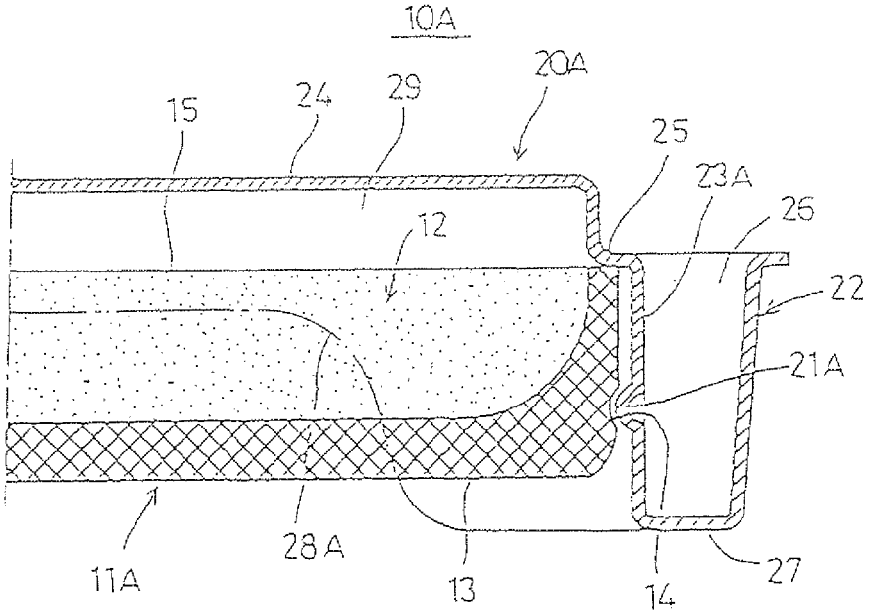
FIG. 7 is an enlarged sectional view showing an area including an engaging portion of the refill container according to the first embodiment of the present invention.
Figure 8:
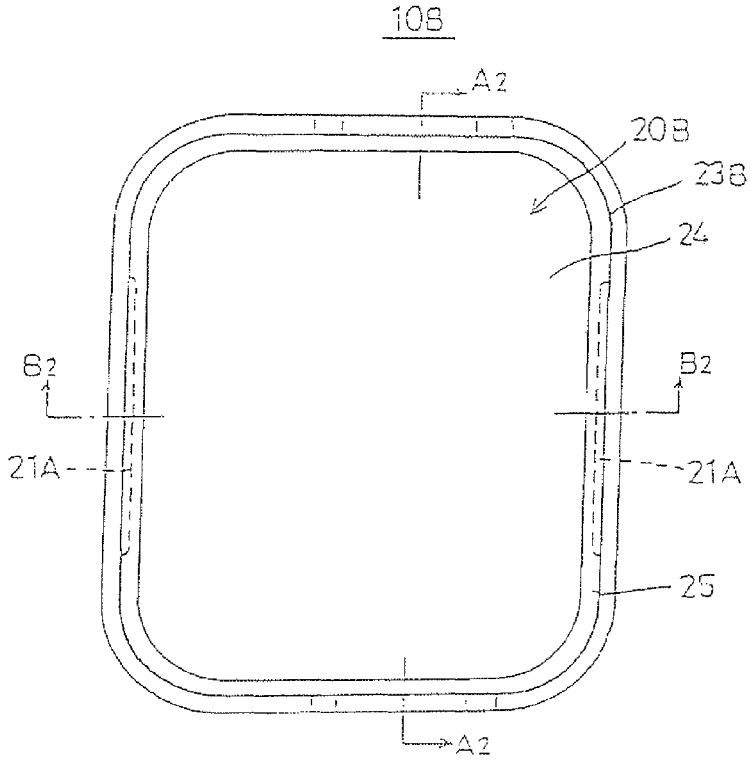
FIG. 8 is a plan view showing a refill container according to a second embodiment of the present invention.
Figure 9:
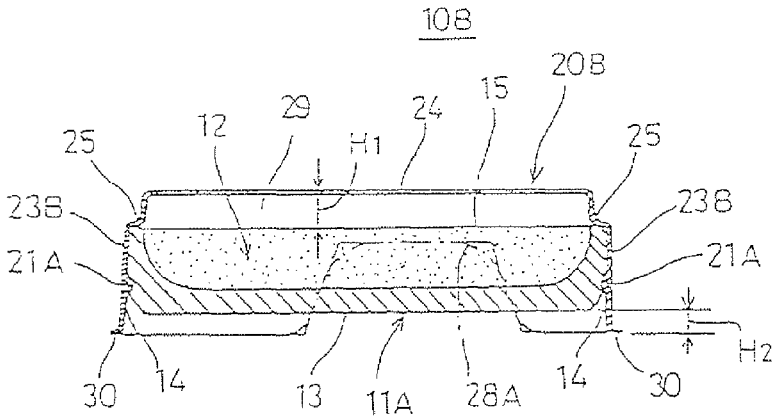
FIG. 9 is a sectional view taken along the line B2-B2 of FIG. 8.
Figure 10:
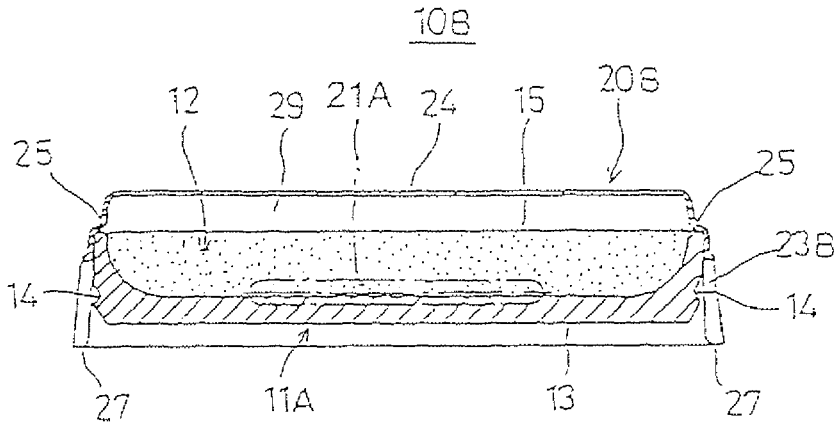
FIG. 10 is a sectional view taken along the line A2-A2 of FIG. 8.

As shown in FIGS. 5 through 7, the holding portion 23A is configured to confront a lateral surface of the internal tray 11A when the internal tray is in a mounted state (hereinafter, referred to as "when in the mounted state"). The holding portion 23A has the engaging portion 21A, which protrudes towards inside (i.e., toward the place where the internal tray 11A is when in the mounted state).

A catching groove 14 is formed at the lateral surface of the internal tray 11A making a structure where the catching groove 14 engages with the engaging portion 21A when the tray 11A is in the mounted state on the mounting portion 20A. FIG. 7 shows an enlarged view of when the catching groove 14 and the engaging portion 21A are engaged. An engaging force produced by this engagement of the engaging portion 21A in the catching groove 14 retains the internal tray 11A within the mounting portion 20A.

Figure 4:
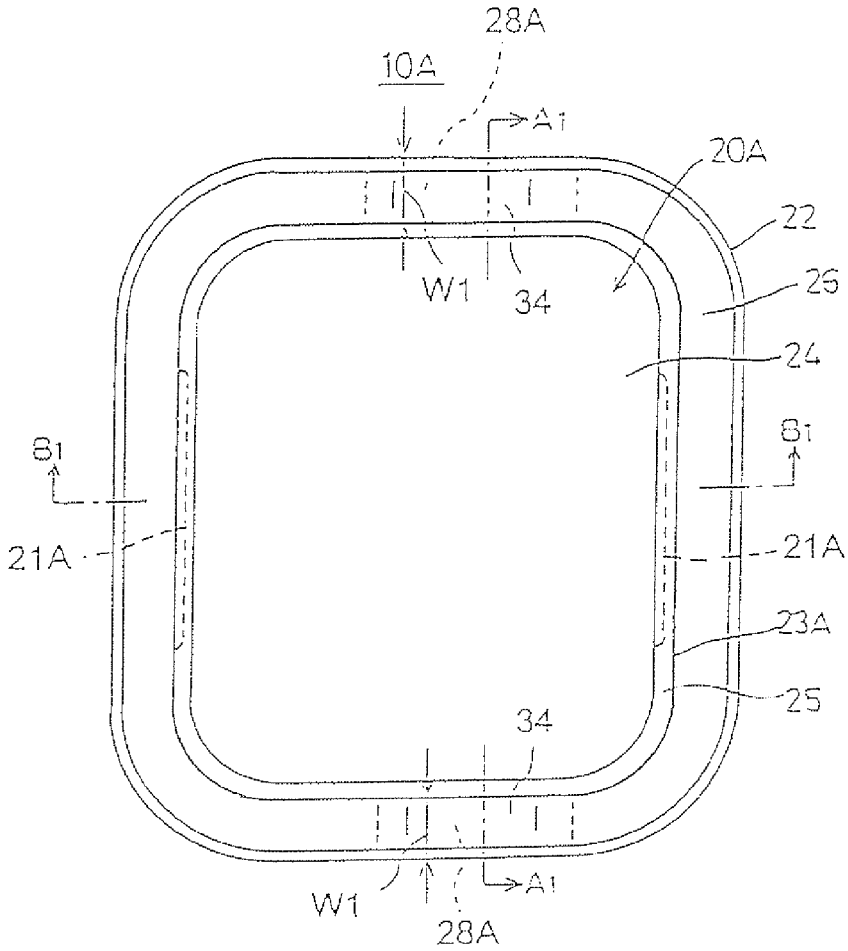
FIG. 4 is a plan view showing the refill container according to the first embodiment of the present invention.

The lid portion 24 is configured in such a manner as to have a smaller area in plan view than the holding portion 23A as shown in FIG. 4. Thus, the step portion 25 is formed between the lid portion 24 and the holding portion 23A.

The step portion 25 is configured in such a manner as to be in contact with an upper end portion of the internal tray 11A. Thus, the catching groove 14 of the internal tray 11A catches the engaging portion 21A as stated above and the upper end portion of the internal tray 11A comes into contact with the step portion 25, thereby holding and retaining the internal tray 11A within the mounting portion 20A steadily.

Further, as shown in FIGS. 5 through 7, the lid portion 24 is configured in such a manner as to face an exposed surface 15 of the cosmetic material 12 that is exposed to the outside when in the mounted state of the internal tray 11A. In this way, the exposed surface 15 of the cosmetic material 12 is protected by the lid portion 24.

When this is effected, the lid portion 24 is not in contact with the exposed surface 15 closely but is configured to be spaced apart by a clearance H1 shown with arrows in FIG. 5. In other words, there is a structure that has a space 29 between the lid portion 24 and the exposed surface 15.

This structure allows the lid portion 24 to be deformed to absorb external forces (vibrations, impacts, etc.) that might be applied to the lid portion 24. Thus, the cosmetic material is protected from damage (for example, damage that might cause irregularities in the exposed surface 15) and is kept from being scattered.

The turn-back portion 22 is a region that is formed at a peripheral position of the holding portion 23A. This region is shaped in such a manner as to extend from the holding portion 23A and then turn back, thereby defining a recessed portion 26 within the turn-back portion 22.

A lower end portion 27 (that is the turning back part) of the turn-back portion 22 in the figure protrudes downward relative to an internal-tray bottom surface 13 of the internal tray 11A in the mounted state by a predetermined height H2 (shown with the arrows in FIG. 5). Further, a finger hold portion 28A having a recessed shape is formed at a predetermined location of the turn-back portion 22.

As described above, the catching groove 14 of the internal tray 11A in the mounted state is engaged with the engaging portion 21A. When the internal tray 11A is taken out of the refill container 10A, the internal tray 11A is directly gripped by the user via the finger hold portion 28A and the internal tray 11A is pulled out of the refill container 10A. Therefore, by providing the finger hold 28A, the operation to take the internal tray 11A out of the refill container 10A can be easily carried out without being disturbed by the turn-back portion 22 formed at the periphery of the holding portion 23A.

As stated above, the refill container 10A of this embodiment has the turn-back portion 22 formed at the periphery of the holding portion 23A, therefore, the strength of the holding portion 23A can be reinforced. Further, when an external force is applied sideways relative to the internal tray 11A, the external force can be absorbed by the deformation of the turn-back portion 22. Thus, the protection of the internal tray 11A is effected with increased reliability.

Further, in the mounted state, the end portion 27 (the turning back part) of the turn-back portion 22 protrudes from the internal-tray bottom surface 13 of the internal tray 11A. Therefore, when an external force is applied from below, the part of the end portion 27 protruding from the internal-tray bottom surface 13 serves as a buffer, which can be utilized to protect the internal tray 11A.

Further, when the internal tray 11A is mounted in the refill container 10A, as for the refill container 10A of this embodiment, it is sufficient to merely insert the internal tray 11A into the holding portion 23A, which also achieves the engagement between the internal tray 11A and the engaging portion 21A. Therefore, a single motion to insert the internal tray 11A into the mounting portion 20A can mount the internal tray 11A in the refill container 10A. Thus, the operation to mount the internal tray 11A in the refill container 10A can be simplified and the efficiency of the operation can be increased.

Further, the refill container 10A of this embodiment is configured in such a manner as to protect the exposed surface 15 of the cosmetic material 12 (i.e., where the protection is most necessary) by means of the lid portion 24 and to hold the internal tray 11A with its internal-tray bottom surface 13 in an exposed state. Therefore, the refill container 10A of this embodiment can be reduced in size as compared with those conventional structures (FIGS. 1 and 2) where the refill main body 2 and the lid portion 3 make up the refill container 1 and the internal tray 6 is completely housed within the refill container 1.

Consequently, the cost of raw materials to form the refill container 10 can be reduced. Further, as for the packing process, since packing boxes can be reduced in size, packaging cost can be reduced. Further, when a vanity case is refilled with the internal tray 11A, the refill container 10A is to be discarded. The size reduction of the refill container 10A contributes to the reduction of waste.

It should be noted that, although the internal-tray bottom surface 13 of the internal tray 11A mounted in the refill container 10A of this embodiment is exposed from the mounting portion 20A, the exposed surface 15 of the cosmetic material 12 is protected by the lid portion 24 as stated above, and, because the internal tray 11A is a plastic tray body, the cosmetic material 12 does not deteriorate when the internal-tray bottom surface 13 is exposed to the outside.

Next, the second embodiment of the present invention is described.

Figure 3:
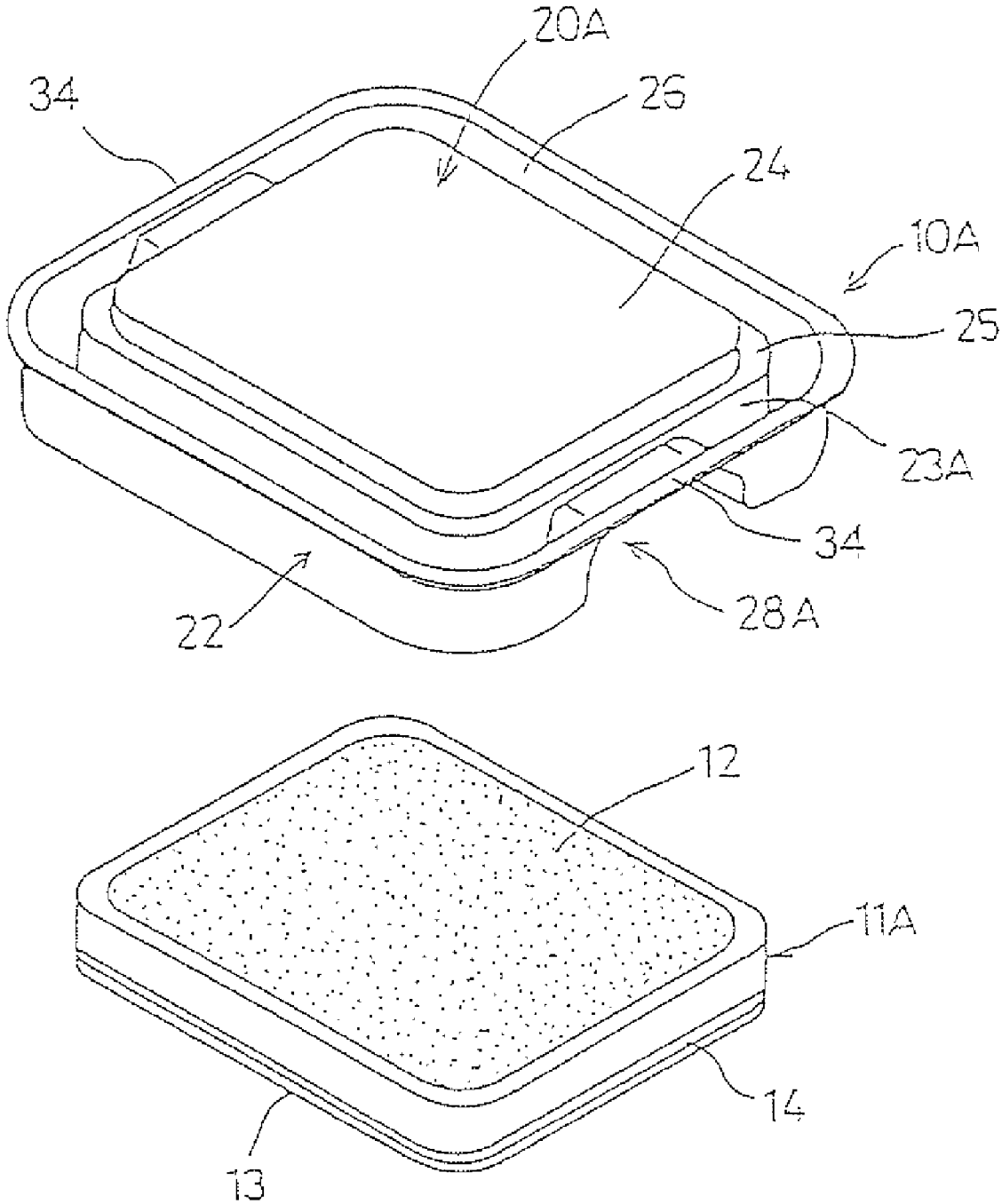
FIG. 3 is a perspective view showing a refill container according to a first embodiment of the present invention.

FIGS. 8 through 11 show a refill container 10B of the second embodiment. It should be noted that those configurations in FIGS. 8 through 11 that are the same as the aforementioned ones of the refill container 10A of the first embodiment described with reference to the FIGS. 3 and 7 are indicated by the same reference numerals and description for them is omitted. Later in the description, the same thing applies to the third through sixth embodiments and FIGS. 12 through 27, which are used for describing the third through sixth embodiments.

Figure 2:
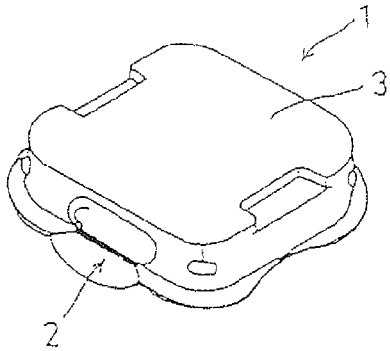
FIG. 2 PRIOR ART
FIG. 2 is a perspective view showing a conventional refill container with its lid closed.

The refill container 10A of the first embodiment is particularly configured to prevent the external force from being applied directly onto the internal tray 11A from the side portion by the provision of the turn-back portion 22. However, the configuration that provides the turn-back portion 22 at the outside of the mounting portion 20A is still quite large relative to the contour of the internal tray 11A, although it can effect reductions in size and in material cost as compared with the conventional refill container 1 (FIGS. 1 and 2).

Thus, the refill container 10B of the second embodiment is characterized in that it is configured without the turn-back portion 22 of the first embodiment. This configuration is capable of making the size of the refill container 10B nearly the same as the internal tray 11A, thereby allowing further reductions in size and material cost.

As for the protecting function of the refill container 10B of this embodiment to protect the internal tray 11A, since the lid portion 24 is configured in the same manner as the first embodiment, it can protect the cosmetic material 12 with nearly the same reliability as the first embodiment.

Further, with regard to the external force from below, an end portion 30 of a holding portion 23B protrudes from the internal-tray bottom surface 13 of the internal tray 11A by the predetermined height H2 (shown with arrows in FIG. 9) when the internal tray 11A is mounted in the holding portion 23B. Therefore, the protruding portion can absorb the above mentioned external force. Thus, the internal tray 11A can be protected when the external force is applied from below the refill container 10B.

Further, when an external force is applied to the refill container 10B sideways, with the absence of the turn-back portion 22, the external force is directly applied to the side surface of the internal tray 11A, which is usually made of rigid plastic and is relatively strong.

Further, when the refill container 10B is in a carton (a container to pack the refill container 10B when shipping) and an external force is applied sideways, since the refill container 10B comes in contact with an inside surface of the side wall of the carton along a line that connects a shoulder portion of the step portion 25 with the end portion 30 (evened-out periphery portion) of the refill container 10B, mechanical shock to the internal tray 11A is reduced. Further, since the clearance between the carton and the contents in the carton is small (about 3 mm), there is a vertical restriction, and the periphery of the end portion 30 and the bottom portion 24 are brought into contact with the carton. Therefore, when held in the carton, the step portion 25 does not hit against the carton. Consequently, the mechanical shock applied to the internal tray 11A is small.

Figure 11:
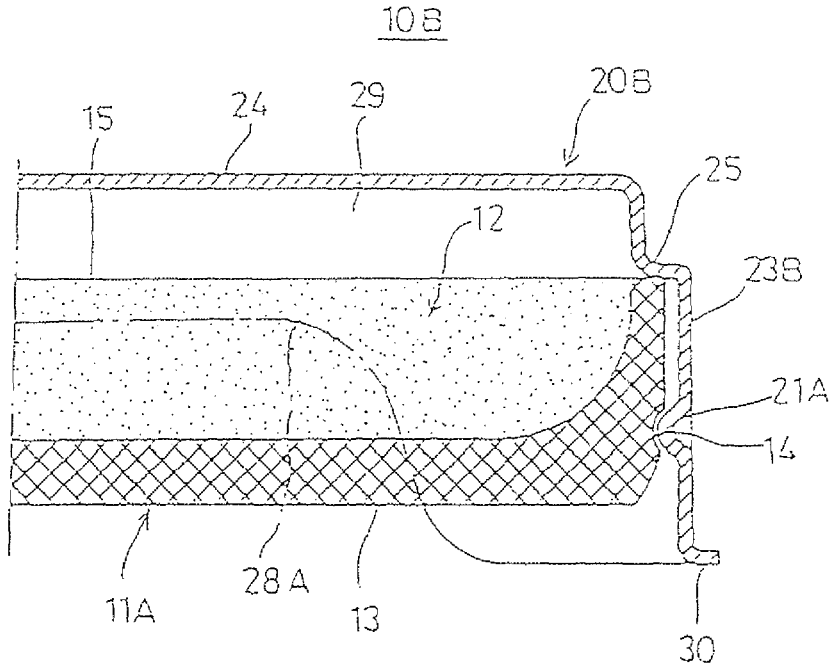
FIG. 11 is an enlarged sectional view showing an area including an engaging portion of the refill container according to the second embodiment of the present invention.

Further, as shown in the enlarged view in FIG. 11, there is a small clearance formed between the internal tray 11A and the holding portion 23B. The holding portion 23B is flexibly deformable in this small clearance. Moreover, the engaging portion 21A is slightly flexibly deformable. Therefore, each of these flexible deformations can absorb the external force applied sideways relative to the refill container 10B.

Consequently, the internal tray 11A and the cosmetic material 12 that is contained in the internal tray can be protected from damage when the external force is applied sideways relative to the refill container 10B of this embodiment, too.

Next, the third embodiment of the present invention is described.

Figure 12:
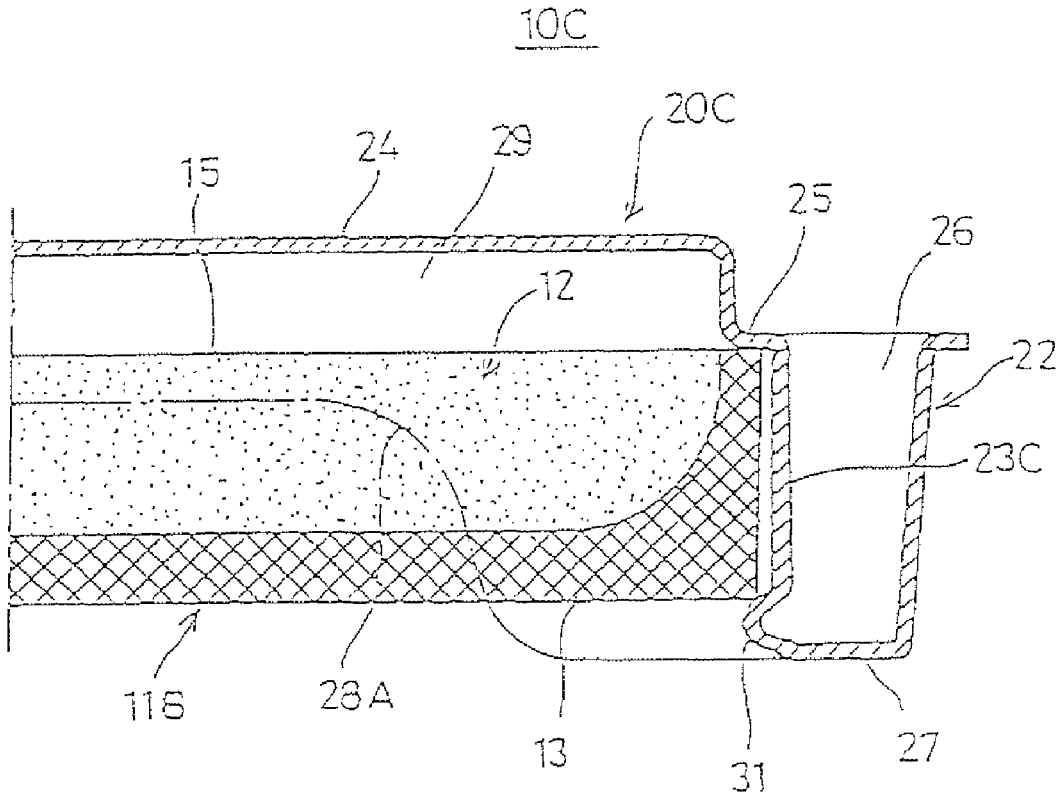
FIG. 12 is an enlarged sectional view showing an area including an engaging portion of a refill container according to a third embodiment of the present invention.

FIG. 12 shows a refill container 10C of the third embodiment. The refill container 10A of the aforementioned first embodiment is configured in such a manner that the internal tray 11A is held within the mounting portion 20A by the engagement of the engaging portion 21A with the catching groove 14 formed at the side surface of the internal tray 11A.

In contrast, the refill container 10C of this embodiment is characterized in that an engaging portion 31 is engaged with the internal-tray bottom surface 13 of the internal tray 11B. The engaging portion 31 is formed in the shape of a rib and is configured to be capable of being flexibly deformed to allow insertion of the internal tray 11B when the internal tray 11B is inserted and mounted in the holding portion 23C. Further, it is configured to elastically return to the original shape and engage with the internal-tray bottom surface 13 of the internal tray 11B when the internal tray 11B is inserted into a predetermined mounting position.

With the above configuration, it is not necessary to form a catching groove at the side surface of the internal tray 11B. Thus, it is possible to simplify the configuration of the internal tray 11A and enhance its moldability. Further, the engaging force between the engaging portion 31 and the internal tray 113 can be increased, and therefore, it is possible to hold the internal tray 11B with increased reliability. Needless to say, the internal tray 11A used in the aforementioned embodiments having the catching groove 14 at its side can also be mounted in the refill container 10C of this embodiment.

Next, the fourth through sixth embodiments of the present invention are described.

The refill container 10A of the aforementioned first embodiment is configured to form the finger hold portion 28A by forming the recessed portion in the turn-back portion 22, as shown in FIGS. 3 and 4, and therefore, there is a flange-shaped portion 34 formed in the shape of a flange projecting above the finger hold portion 28A.

In that configuration, however, the height H3 (shown with arrows in the figure) of the finger hold portion 28A taken from the end portion 27 is low, as shown in FIG. 5. It is lower than the exposed surface 15 of the internal tray 11A. Therefore, the area of the internal tray 11A that is exposed to the finger hold portion 28A becomes small. Further, there is the structure of the flange-shaped portion 34 in the shape of a flange extending above the position where the internal tray 11A is exposed.

Therefore, there is a problem in that a finger of a user can not easily be put on the side surface of the internal tray 51A when the finger is put at the finger hold portion 28A in order to take the internal tray 11A out of the refill container 10A. In particular, a user who has long nails, which are caught in the flange-shaped portion 34, cannot grip the side surface of the internal tray 11A. In such cases, it is very tiring to take out the internal tray 11A. Solutions to this problem are provided in the fourth through sixth embodiments that are described below.

Figure 13:
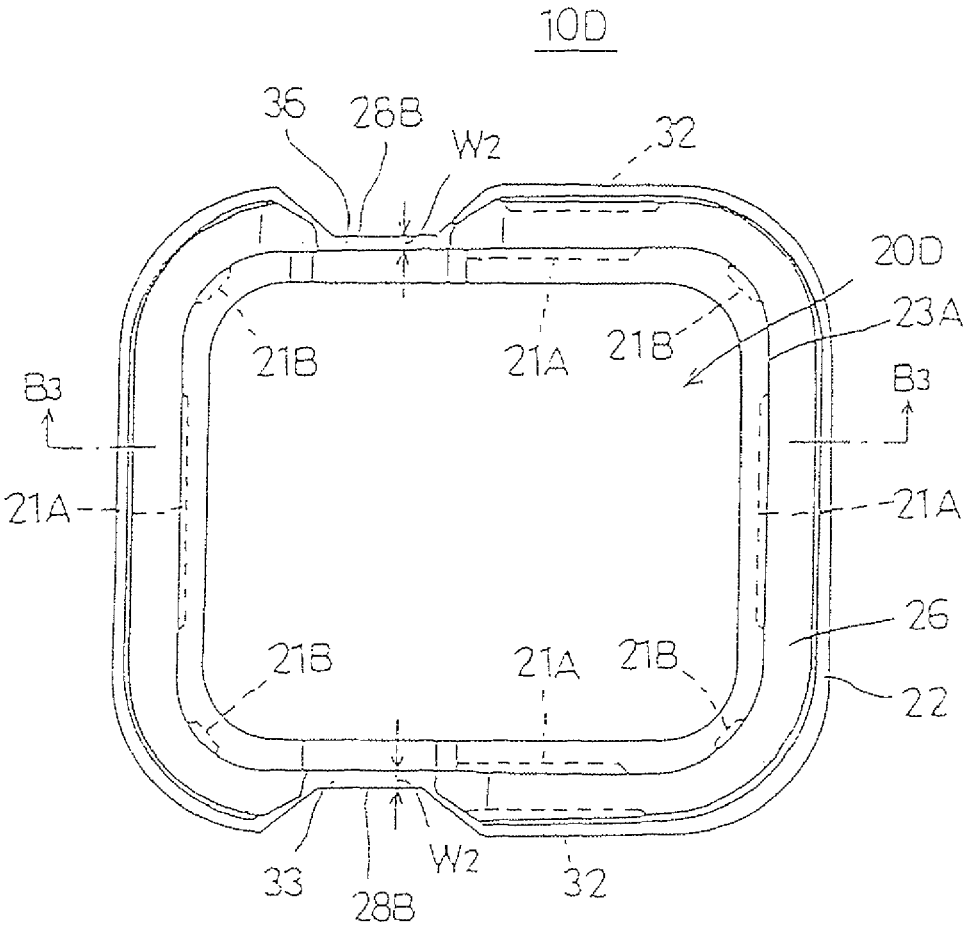
FIG. 13 is a plan view showing a refill container according to a fourth embodiment of the present invention.
Figure 14:
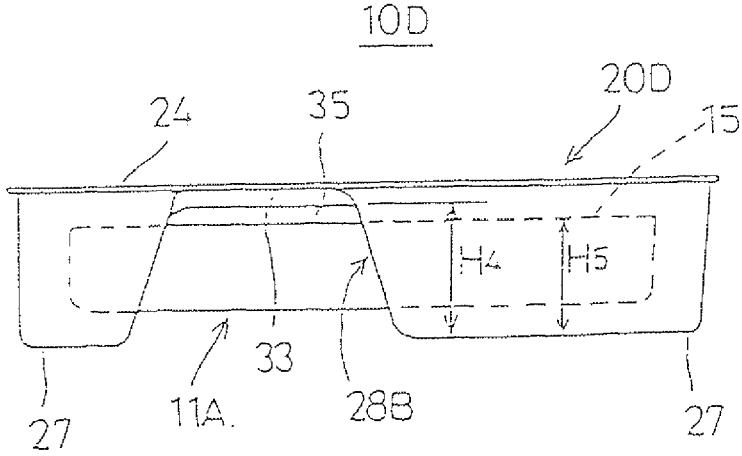
FIG. 14 is a front elevation showing the refill container according to the fourth embodiment of the present invention.
Figure 15:
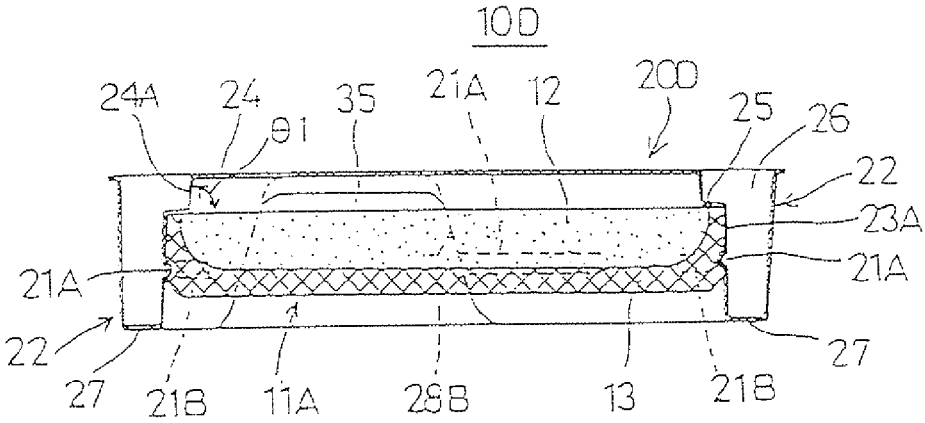
FIG. 15 is a sectional view taken along the line B3-B3 of FIG. 13.

FIGS. 13 through 15 show a refill container 10D of the fourth embodiment. FIG. 13 is a plan view of the refill container 10D. FIG. 14 is a front elevation of the refill container 10D. FIG. 15 is a sectional view taken along the line B3-B3 of FIG. 13.

This embodiment is arranged in such a manner that an upper edge of a finger hold portion 28B is higher than the exposed surface 15 of the internal tray 11A. More specifically, as shown in FIG. 14, when H5 represents the height of the exposed surface 15 of the internal tray 11A taken from the end portion 27 of a mounting portion 20D and H4 stands for the height of the upper edge of the finger hold portion 28B taken from the end portion 27, this embodiment is arranged in such a manner that H4>H5 is satisfied. With this configuration, the side surface of the internal tray 11A is entirely exposed to the finger hold portion 28B.

Further, as shown in FIG. 13, the finger hold portion 28B of this embodiment is configured so as to have a shape deeply indented toward the holding portion 23A. In this plan view, a flange-shaped portion 33 of the finger hold portion 28B has a width W2 (shown with arrows in FIG. 13), which is smaller than the width W1 (shown in FIG. 4) of the flange-shaped portion 34 of the first embodiment (i.e., W2<W1).

As stated above, the lateral surface of the internal tray 11A in the finger hold portion 28B of the refill container 10D of this embodiment is entirely exposed, and the width of the flange-shaped portion 33 at the upper edge of the finger hold portion 28B is narrow.

Therefore, when a user who has a long nail tries to take the internal tray 11A out of the refill container 10D, the nail does not run into the flange-shaped portion 33 and a finger of the user can be engaged with the side surface of the internal tray 11A without fail. Thus, the user can grip the internal tray 11A steadily and can take the internal tray 11A out of the refill container 10D easily and without fail.

On the other hand, there is some concern that the internal tray 11A may be unexpectedly disengaged from the refill container 10D due to a deformation of the refill container 10D caused by an external force exerted at the point where the strength of the refill container 10D is reduced because of the formation of the finger hold portion 28B deeply curved toward the mounting portion 20D.

Therefore, this embodiment provides not only the engaging portion 21A that is formed at a position facing the side surface of the internal tray 11A and engages with the internal tray 11A as the aforementioned embodiments but also engaging portions 21B at the four corners of the mounting portion 20D, making a configuration such that the mounting portion 20D is engaged with the internal tray 11A at the four-corner positions of the mounting portion 20D, too.

Further, there is provided a rib 32 formed in the neighborhood of the finger hold portion 28B of the turn-back portion 22. The rib 32 is provided in order to be helpful when the refill container 10D is manufactured in an automated manner. To be more precise, if the rib 32 is not provided, when a robot handles the refill containers 10D with the internal trays 11A mounted therein in a finishing automated line production system in order to transport them to the next step, there would be no place to be gripped by the robot and the handling would become difficult. This is why the rib 32 is formed at the refill container 10D.

Further, when refill containers 10D are supplied to a manufacturing line, usually, tens of refill containers 10D in a stacked-up state are one-by-one handled by a machine and supplied to the line. In such instances, if the refill containers 10D are stacked fitting deeply into each other, it would be difficult to handle them one-by-one automatically (and it can happen that some of them are handled and sent as they are still in the stacked state). For this reason, or for the purpose of preventing the refill containers from fitting deeply into each other when they are stacked, this embodiment provides the formation of the rib 32.

Figure 16:
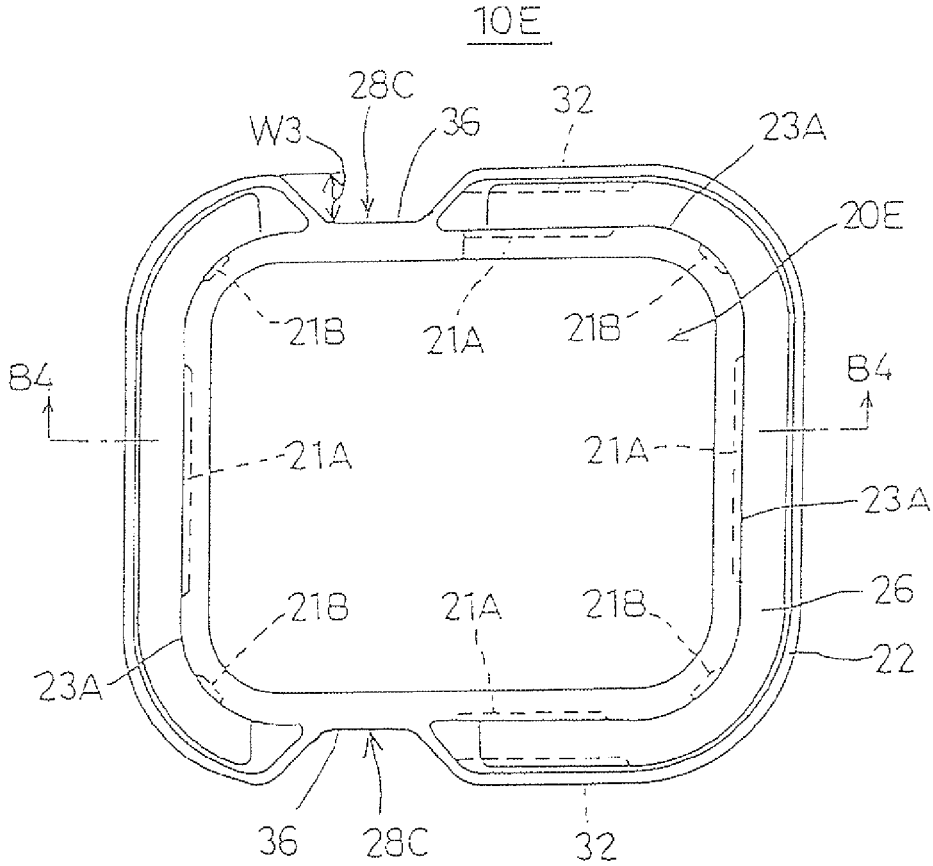
FIG. 16 is a plan view showing a refill container according to a fifth embodiment of the present invention.
Figure 17:
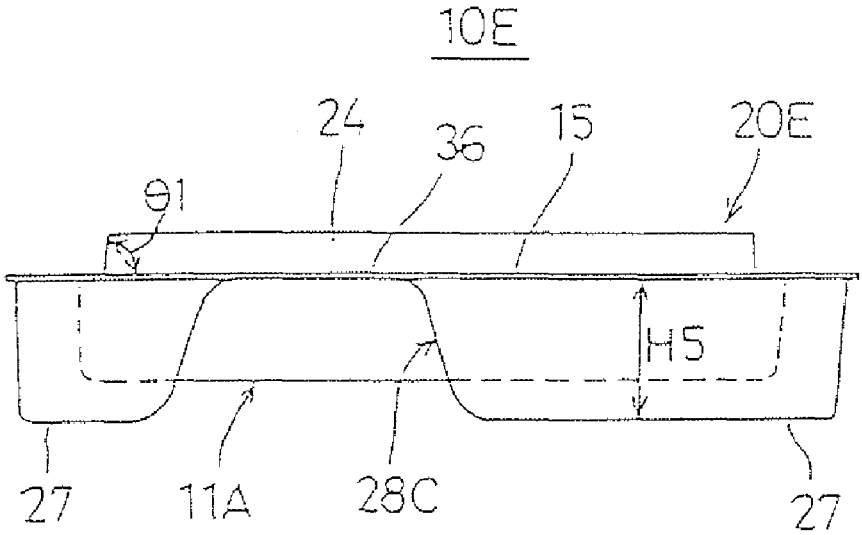
FIG. 17 is a front elevation showing the refill container according to the fifth embodiment of the present invention.
Figure 18:
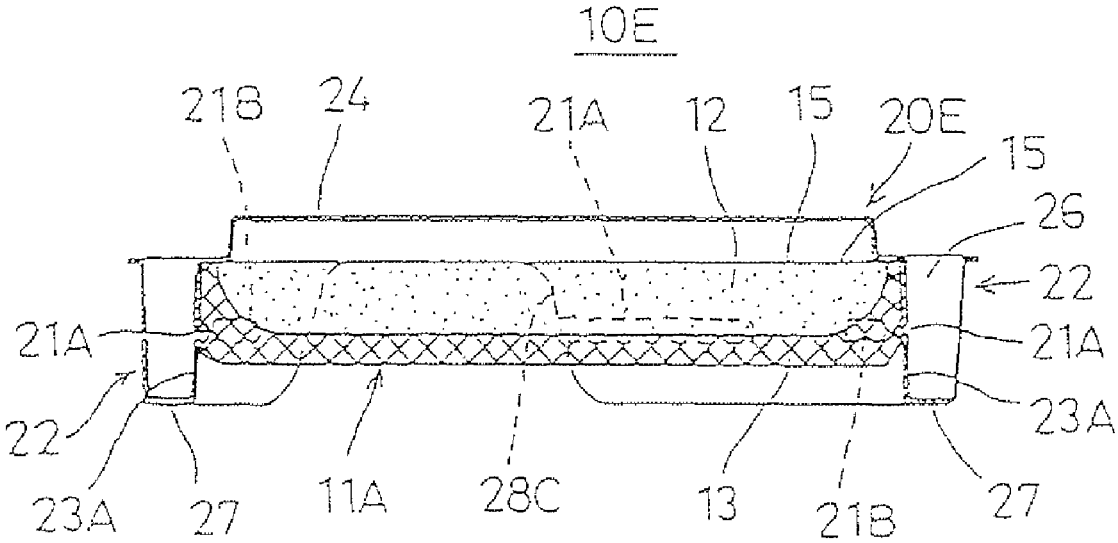
FIG. 18 is a sectional view taken along the line B4-B4 of FIG. 16.

FIGS. 16 through 18 show a refill container 10E of the fifth embodiment. FIG. 16 shows a plan view of the refill container 10E. FIG. 17 shows a front elevation of the refill container 10E. FIG. 18 is a cross sectional view taken along the line B4-B4 of FIG. 16. In each figure, those configurations that are the same as the aforementioned ones of the fourth embodiment are indicated by the same reference numerals and description for them is omitted.

In the above stated fourth embodiment, because the height H4 of the upper edge of the finger hold portion 28B from the end portion 27 is larger than the height H5 of the exposed surface 15 of the internal tray 11A from the end portion 27 of the mounting portion 20D (i.e., H4>H5), a space 35 is formed on the finger hold portion 28B and between the mounting portion 20D and the exposed surface 15 of the internal tray 11A as is shown in FIG. 14. The existence of the space 35 does not affect the quality of the cosmetic material 12 filled in the internal tray 11A, however, customers may doubt whether the cosmetic material 12 is unused.

In view of this, a refill container 10E of this embodiment is characterized in that the position of the upper edge of a finger hold portion 28C corresponds to the exposed surface 15 of the internal tray 11A when the internal tray 11A is held in the refill container 10E.

Moreover, as compared with the refill container 10D of the fourth embodiment (wherein the flange-shaped portion 33 exists with its width W2 at the upper edge of the finger hold portion 28B), the refill container 10E of this embodiment is configured in such a manner that there is no flange-shaped portion at the upper edge of the finger hold portion 28C. More specifically, the holding portion 23A is configured in close conformity with a contact portion 36 on which a finger of the user leans when the user manipulates the finger hold portion 28C.

Thus, with the refill container 10E of this embodiment, the space 35 is not formed (in contrast to the fourth embodiment where the space 35 is formed), therefore, superfluous customer doubts about the unused condition of the cosmetic material 12 are prevented from arising.

Further, since the finger hold portion 28C is almost free from the flange-shaped portion, the user can immediately grip the side surface of the internal tray 11A through simply putting his/her finger at the finger hold portion 28C. Consequently, the refill container 10E of this embodiment can be provided with more enhanced user-friendliness than the refill container 10D of the fourth embodiment.

Figure 19:
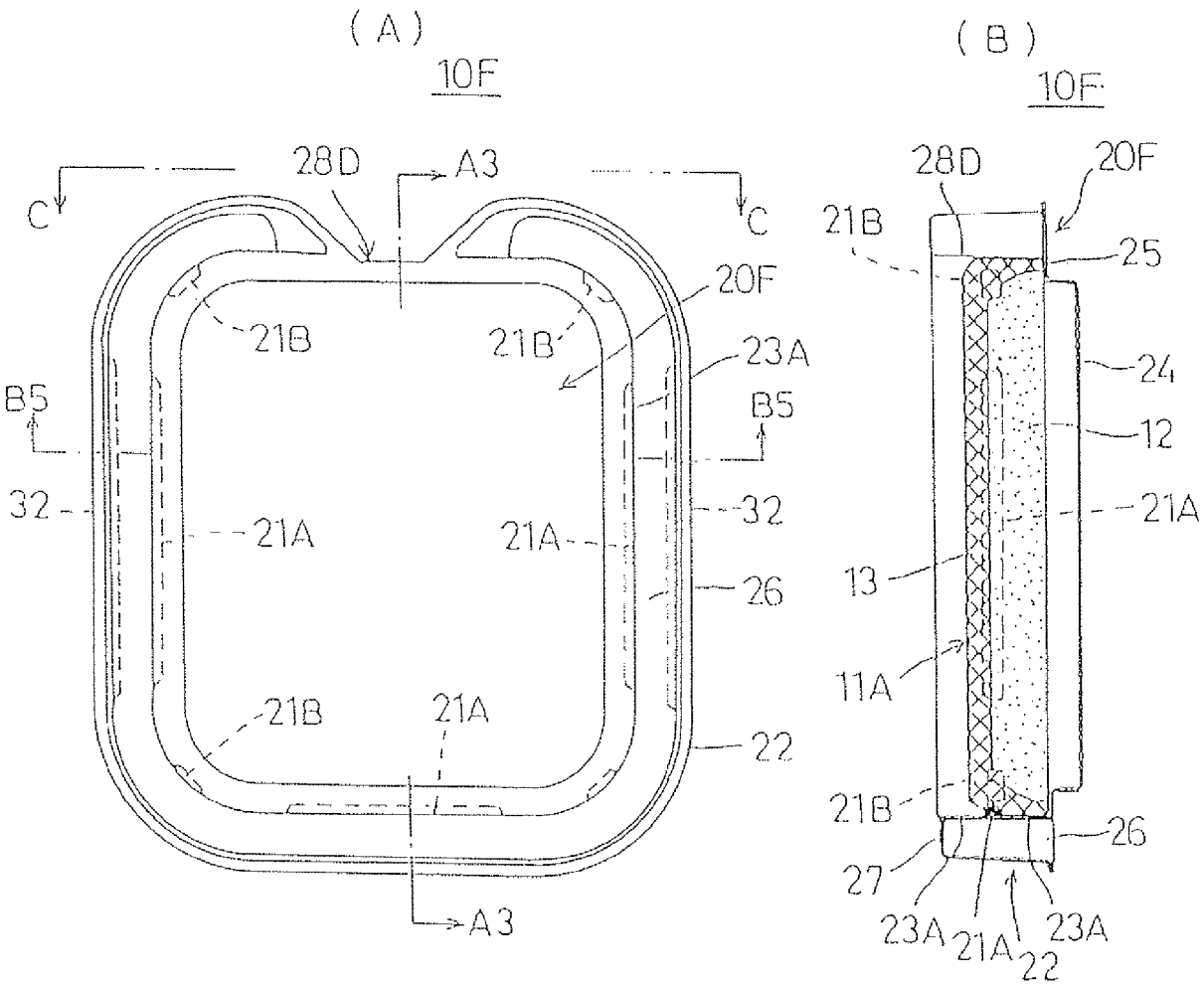
FIG. 19(A) is a plan view showing a refill container according to a sixth embodiment of the present invention.
FIG. 19(B) is a sectional view taken along the line A3-A3 of FIG. 19(A).
Figure 20:
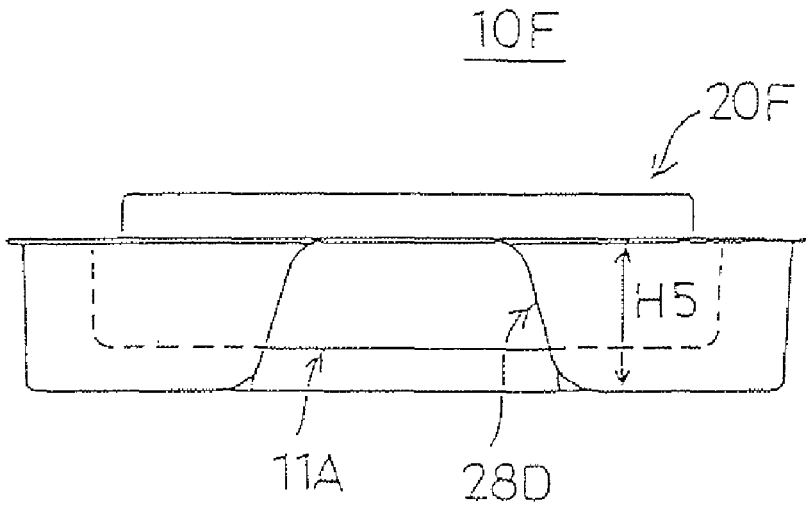
FIG. 20 is a view seen in the direction of arrows C-C of FIG. 19(A).
Figure 21:
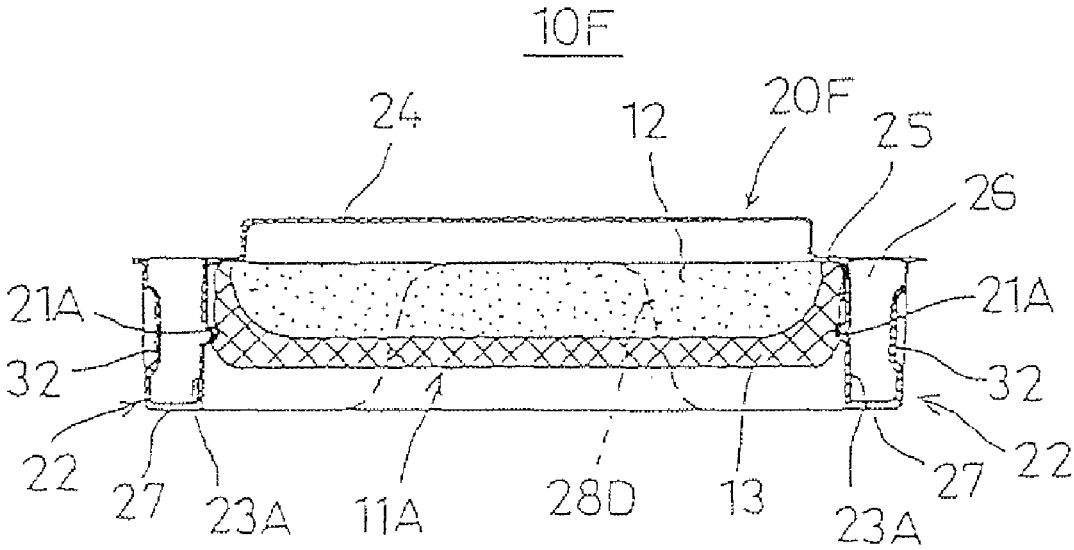
FIG. 21 is a sectional view taken along the line B5-B5 of FIG. 19(A).

FIGS. 19 through 21 show a refill container 10F of the sixth embodiment. FIG. 19(A) is a plan view of the refill container 10F. FIG. 19(B) is a sectional view taken along the line A3-A3 of FIG. 19(A). FIG. 20 is a view seen in the direction of arrows C-C of FIG. 19(A). FIG. 21 is a sectional view taken along the line B5-B5 of FIG. 19(A). In each figure, those configurations that are the same as the aforementioned ones of the fourth and fifth embodiments are indicated by the same reference numerals and description for them is omitted.

A finger hold portion 28D provided in this embodiment has a configuration that is basically the same as that of the finger hold portion 28C provided in the refill container 10E of the fifth embodiment. However, this embodiment is characterized in that there is only one finger hold portion 28D provided, in contrast to the refill container 10E of the fifth embodiment, which has a pair of finger hold portions 28C arranged in opposite positions.

As stated above, the refill container 10F of this embodiment is configured to have only one finger hold portion 28D disposed. Therefore, the mechanical strength of the refill container 10F becomes greater than that of the other embodiments. Consequently, the disengagement of the internal tray 11A from the refill container 10F can be more reliably prevented. Further, having only one finger hold portion 28D means that the internal tray 11A can be taken out of the refill container 10F by one finger, and the user-friendliness at the demounting time can be improved.

Figure 22:
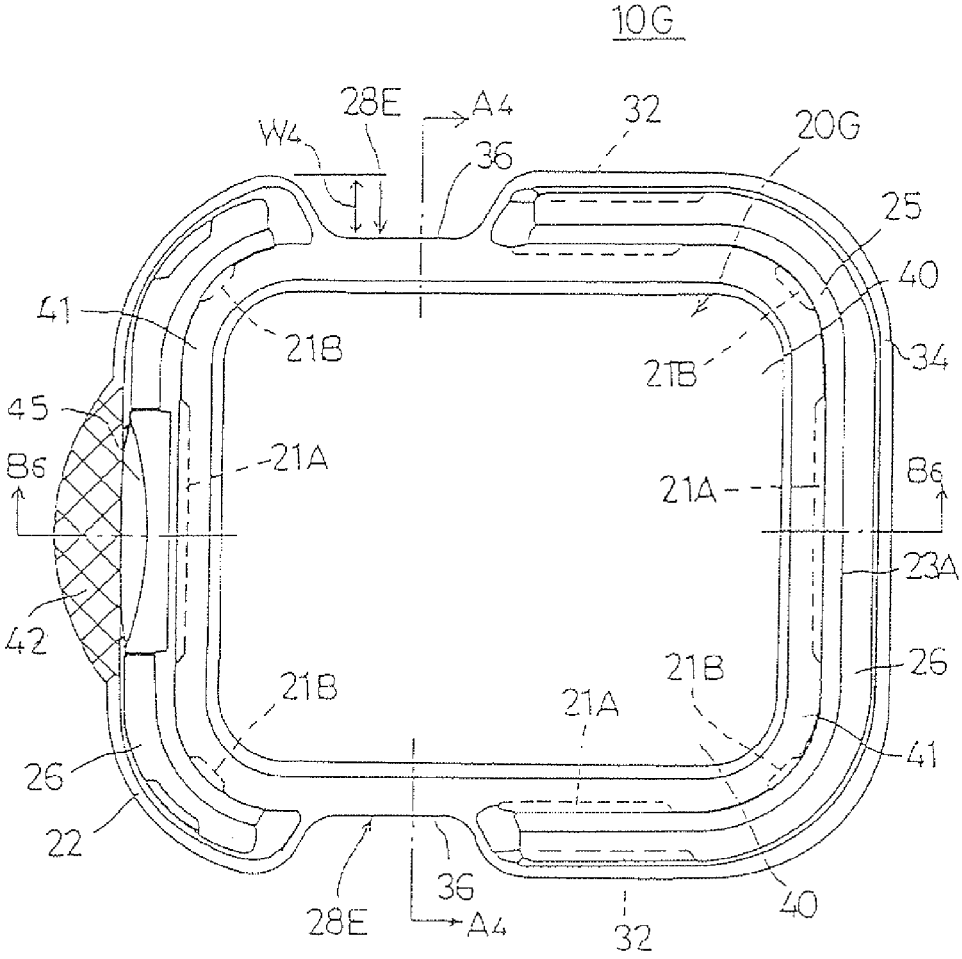
FIG. 22 is a plan view showing a refill container according to a seventh embodiment of the present invention.
Figure 23:
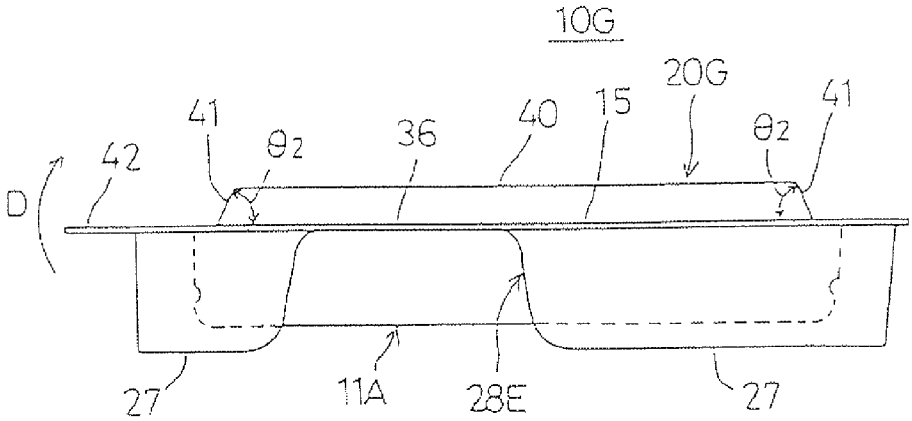
FIG. 23 is a front elevation showing the refill container according to the seventh embodiment of the present invention.
Figure 24:
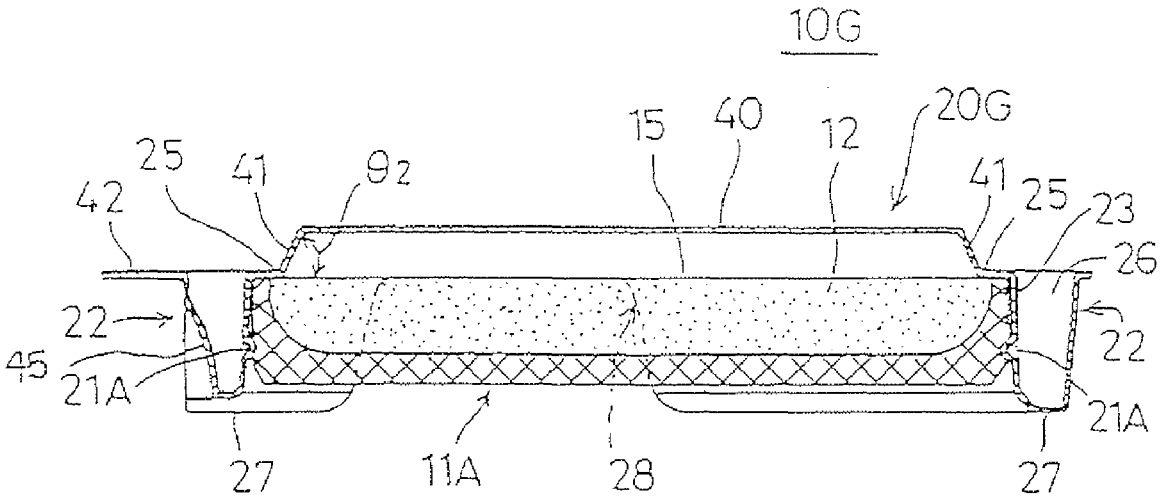
FIG. 24 is a sectional view taken along the line B6-B6 of FIG. 22.
Figure 25:
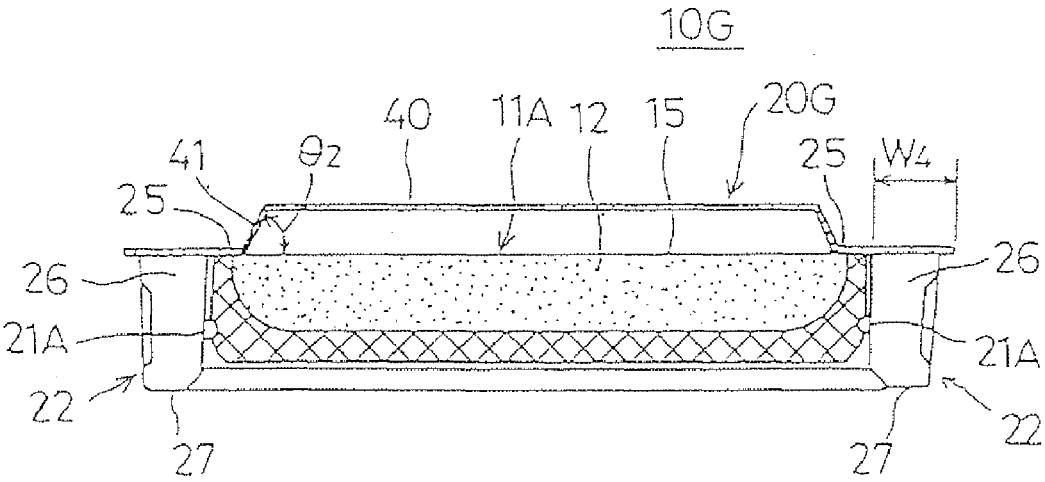
FIG. 25 is a sectional view taken along the line A4-A4 of FIG. 22.
Figure 26:
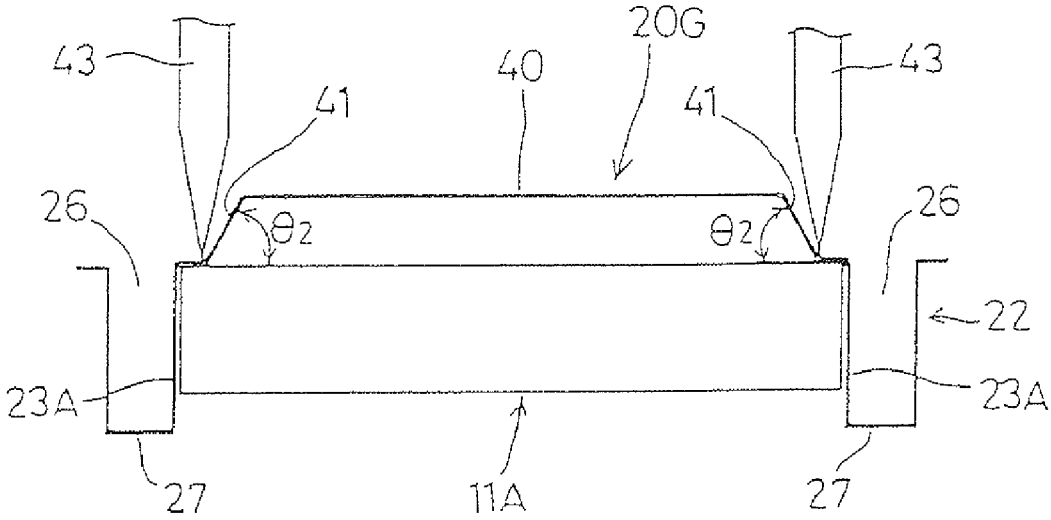
FIG. 26 is an explanatory view for a method of forming a finger hold portion.
Figure 26:
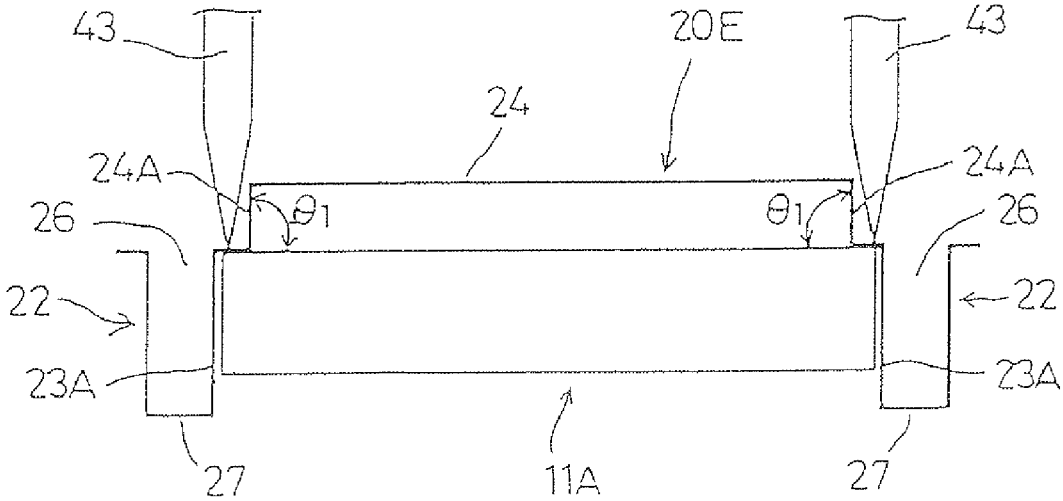

FIGS. 22 through 25 show a refill container 10G of the seventh embodiment. FIG. 22 is a plan view of the refill container 10G. FIG. 23 is a front elevation of the refill container 10G. FIG. 24 is a sectional view taken along the line B6-B6 of FIG. 22. FIG. 25 is a sectional view taken along the line A4-A4 of FIG. 22. In each figure, those configurations that are the same as the aforementioned ones of the fifth embodiment are indicated by the same reference numerals and description for them is omitted.

The refill container 10D of the fourth embodiment described with reference to FIGS. 12 through 15 and the refill container 10E of the fifth embodiment described with reference to FIGS. 16 through 18 (both of these refill containers are described above) are configured to have the finger hold portions 28B and 28C formed on both long-side side surfaces of the mounting portions 20D and 20E. Since the finger hold portions 28B and 28C are formed, the refill containers 10D and 10E can be removed from the internal tray 11A, by gripping the internal tray 11A by fingers via the finger hold portions 28B and 28C. Therefore, the internal tray 11A can be easily detached from the refill containers 10D and 10E.

However, when the inventors of the present invention conducted a usability test on the refill containers 10D and 10E, the result was that it was not easy for those who used the refill containers 10D and 10E of the fourth and the fifth embodiments for the first time to understand how to take the internal tray 31A out of the container 10D or 10E.

In view of this, this embodiment is configured to have a finger grip portion 42 provided on a surface of a mounting portion 200 other than the surface on which the finger hold portions 28E are located. More specifically, since the finger hold portions 28E are provided on long-side surfaces of the mounting portion 20G, the finger grip portion 42 is provided on a short-side surface of the mounting portion 20G.

The finger grip portion 42 is formed in such a manner as to extend outwardly from the turn-back portion 22 of the mounting portion 20G. Further the finger grip portion 42 is provided with embossed stripes, which make the user clearly recognize the existence of the finger grip portion 42 and also provide a non-slip feature.

With the above mentioned configuration, when the internal tray 11A is detached from the mounting portion 20G, first the user's fingers hold the internal tray 11A by pinching it via the finger hold portion 28E (as with the refill containers 10D and 10E of the fourth and fifth embodiments), and the finger grip portion 42 is gripped and pulled upward (i.e., in the direction as shown with the arrow D in FIG. 23) away from the internal tray 11A.

Since the finger grip portion 42 extends outwardly from the turn-back portion 22 as stated above, it is easy to grip and hold the finger grip portion 42, and further the embossed finish keeps the finger grip portion 42 from slipping. Moreover, the recessed portion 26 in the neighborhood of the finger grip portion 42 is provided with a structure one step further recessed. As a result, the internal tray 11A can be taken out of the refill container 10G easily and without fail.

Further, since the tongue-shaped finger grip portion 42 is located at the mounting portion 20G, even a first-time user of the refill container 10G can easily sense and realize that the finger grip portion is to be pulled up. On the other hand, in this embodiment, a side-grip portion 45 is formed by a router-tooled embossing at a position below the finger grip portion 42 (FIG. 24), making it also possible to put the finger at the side-grip portion 45 and take out the internal tray 11A. Thus, with the refill container 10G of this embodiment, the internal tray 11A can be taken out by pulling the finger grip portion 42 or by putting the finger at the side-grip portion 45. As a result, even a first-time user of the refill container 10G can take out the internal tray 11A from the refill container 10G easily and without fail.

Regarding a lid portion 40 of the mounting portion 20G, the angle ($\theta 2$ shown with arrows in FIGS. 23 through 25) of a sidewall portion 41 located at the periphery of the lid portion 40 of this embodiment is set small as compared with the angle ($\theta 1$ shown with arrows in FIG. 16) of the sidewall portion 24A located at the periphery of the lid portion 24 of the refill container 10E of the fifth embodiment (i.e., $\theta 1 > \theta 2$). More specifically, the sidewall portion 41 of this embodiment has an inclined surface, in contrast to the sidewall portion 24A of the refill container 10E of the fifth embodiment, which is nearly vertical (i.e., $\theta 1 \approx 90°$).

With this configuration, the depth W4 (shown with arrows in FIGS. 20 and 25) of a finger hold portion 28E of this embodiment can be made deeper than the depth W3 (shown with arrows in FIG. 16) of the finger hold portion 28C of the fifth embodiment (i.e., W4>W3). The reason for doing so is described below with reference to FIG. 26.

FIG. 26(A) shows a method of forming the finger hold portion 28E of this embodiment. FIG. 26(B) shows a method of forming the finger hold portion 28C of the fifth embodiment. As shown in FIGS. 26(A) and 26(B), in order to form the finger hold portions 28E and 28C at the mounting portions 20G and 20E, respectively, a die-cutting process is performed.

A possible cutter to be used for the die-cutting process may be a relatively thin Thompson cutter, however, the relatively thin Thompson cutter is not suitable for mass production because its abrasion resistance property and its durability are not sufficient. Therefore, in order to enable mass production of the refill containers 10E and 10G, it is necessary to employ a steel cutter 43 whose abrasion resistance property and durability are sufficient.

However, the steel cutter is thick. Therefore, when the sidewall portion 24A of the lid portion 24 is nearly vertical (i.e., $\theta 1 \approx 90°$) as shown in FIG. 26(B), it is necessary to set the position in such a manner that the die-cutting process is carried out at a position spaced apart outward from the sidewall portion 24A in order to prevent the steel cutter 43 from interfering with the sidewall portion 24A. Naturally, the finger hold portion 28C formed in this manner has a large flange-shaped portion at the upper edge of the finger hold portion 28C.

In contrast, since the sidewall portion 41 of the lid portion 40 of this embodiment has the slant surface as shown in FIG. 26(A) and the sidewall portion 41 (slanted surface) provides the clearance, the die-cutting process employing the thick steel cutter 43 can be performed at a position in the vicinity of the foot of the sidewall portion 41. As a result, the flange-shaped portion at the upper edge of the finger hold portion 28E can be reduced or completely eliminated, thereby making it possible for the user to merely put his/her finger at the finger hold portion 28E and immediately grip the side surface of the internal tray 11A. Thus, with the configuration of this embodiment, the finger hold portion 28E can be formed efficiently, and the finger hold portion 28E can be formed deeply, which leads to enhanced usability when the internal tray 11A is taken out from the mounting portion 20G.

Each of the above embodiments has been illustrated with respect to the example of using the powdery cosmetic material 12, however, it is also possible to apply the refill containers 10A, 10B and 10C of the present invention to a cosmetic material 12 that requires airtightness, such as an emulsion foundation. If this is the case, then it would be preferable to arrange packings, labels, etc., inside the step portion 25 in order to improve the airtightness between the internal tray (11A, 11B) and the refill container (10A, 10B, 10C) in the mounted state.

Further, although the above embodiments have been illustrated with respect to the example of the internal tray made of plastic material, however, the material of the internal tray is not limited to the plastics, and other materials such as metals can be employed. Further, the shape of the internal tray is not limited to the rectangular type shown in the embodiments. The present invention can be applied to circular, elliptical, or other shapes of internal trays.

Further, when the Emulsion-Pact type internal tray is employed, the internal tray needs to be sealed in an air-tight manner. However, the airtightness of the refilled container containing the Emulsion-Pact type internal tray mounted therein can be easily retained by wrapping it with wrapping materials having gas-barrier properties, such as aluminum laminated films, silica-deposited films, EVAL (trademark for a polyvinylalcohol-polyethylene polymer) films, and the like.

Figure 27:
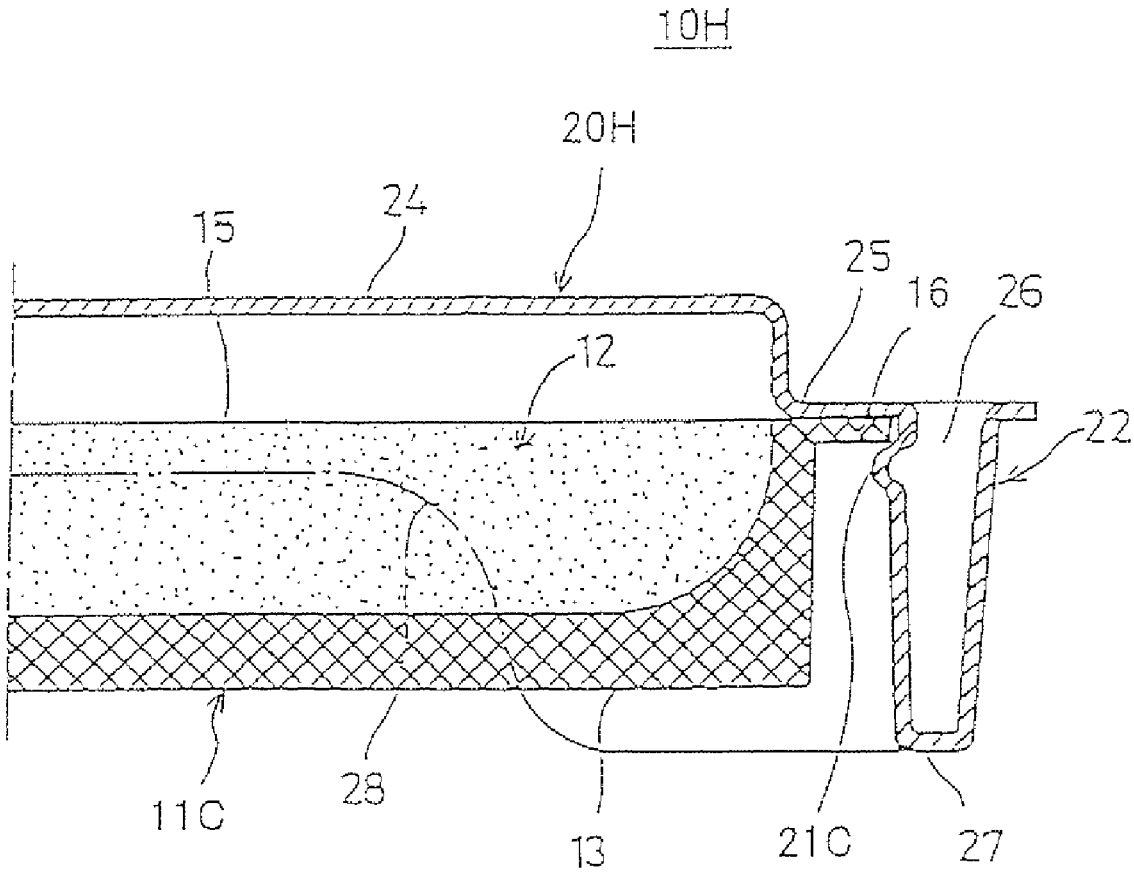
FIG. 27 is a sectional view showing an illustrative Emulsion-Pact internal tray according to the present invention.

As shown for a refill container 10H in FIG. 27, general Emulsion-Pact type internal trays 11C have flange-shaped portions 16 formed at the outer periphery of the opening. Even an internal tray 11C having such a flange-shaped portion 16 can be steadily mounted in a mounting portion 20H, by locating an engaging portion 21C at a high position.

As described above, according to the present invention, the internal tray can be mounted in the refill container by a single motion of inserting the internal tray into the mounting portion. Therefore, the efficiency of the operation of mounting the internal trays in the refill containers can be increased. Further, since the internal tray is not to be completely covered, the size and the material cost of the refill container can be reduced.

Further, since there is the turn-back portion formed at the periphery of the mounting portion, the strength of the mounting portion can be reinforced. Thus, the protection of the internal tray is accomplished with improved reliability. Further, when the internal tray is in the mounted state in the mounting portion, since the turning-back end part of the turn-back portion protrudes from the bottom surface of the internal tray, the protruding portion serves as a buffer when an external impact occurs. As a result, the protection of the internal tray is effected with improved reliability.

Further, an internal tray can be held in the refill container steadily even if no configuration (for example, a groove portion, etc.) that engages with the engaging portion is formed at the internal tray. Further, by forming the finger hold portion at the mounting portion for the purpose of taking out the internal tray, the internal tray can be easily taken out of the mounting portion.

Further, the formation of the finger hold portion can be performed efficiently, and the finger hold portion can be formed deeply, which improves the user-friendliness of the internal tray when being taken out of the mounting portion. Moreover, the internal tray can be further easily taken out of the mounting portion because it can be taken out of the mounting portion by gripping the finger grip portion when the internal tray is taken out of the mounting portion.

The present invention is not limited to the illustratively disclosed embodiments. Various changes and embodiments can be thought of without departing from the claimed scope of the present invention.

The invention claimed is:

1. A refill container comprising:

an internal tray having a material receptacle, a catching groove, and a bottom surface wherein the bottom surface of the internal tray is the lowest surface of the internal tray; and a mounting portion configured to cover an exposed opening of the internal tray receptacle, said mounting portion comprising:

a lid portion that faces and covers said exposed opening of said internal tray receptacle with the mounting portion disposed in a mounted position over the internal tray, wherein in said mounted position the bottom surface of said internal tray is disposed at a level above a bottom edge of said mounting portion;

a holding portion shaped and configured to removably receive the internal tray in the mounted position and wherein the holding portion is provided on the periphery of the lid portion;

an engaging portion that releasably engages the catching groove to removably retain said internal tray in said mounted position, wherein:

a step portion is formed between said lid portion and said holding portion, said step portion being in contact with a top end portion of said internal tray.

* * * * *